US009322193B2

(12) United States Patent
Chen

(10) Patent No.: US 9,322,193 B2
(45) Date of Patent: Apr. 26, 2016

(54) STRUCTURE OF KEY PART HAVING HIDEABLE LOCK CYLINDER

(71) Applicant: Shun-Fu Chen, New Taipei (TW)

(72) Inventor: Shun-Fu Chen, New Taipei (TW)

( * ) Notice: Subject to any disclaimer, the term of this patent is extended or adjusted under 35 U.S.C. 154(b) by 0 days.

(21) Appl. No.: 14/551,201

(22) Filed: Nov. 24, 2014

(65) Prior Publication Data

US 2015/0240523 A1 Aug. 27, 2015

(30) Foreign Application Priority Data

Feb. 26, 2014 (TW) ..... 103203320 U

(51) Int. Cl.

| | |
|---|---|
| ***E05B 19/02*** | (2006.01) |
| ***E05B 19/00*** | (2006.01) |
| ***E05B 19/14*** | (2006.01) |
| ***E05B 75/00*** | (2006.01) |
| *E05B 27/00* | (2006.01) |
| *E05B 19/24* | (2006.01) |
| *E05B 19/04* | (2006.01) |

(52) U.S. Cl.

CPC ..... *E05B 19/00* (2013.01); *E05B 19/14* (2013.01); *E05B 75/00* (2013.01); *E05B 19/046* (2013.01); *E05B 19/24* (2013.01); *E05B 27/00* (2013.01); *Y10T 70/7486* (2015.04)

(58) Field of Classification Search

CPC ..... Y10T 70/404; Y10T 70/7802; Y10T 70/7876; Y10T 70/7842; Y10T 70/8676; Y10T 70/402; Y10T 70/7808; Y10T 70/7825; Y10T 70/7853; Y10T 70/8757; Y10T 70/409; Y10T 70/7881; Y10T 70/40; Y10T 70/7593; Y10T 70/7605; Y10T 70/76661; Y10T 70/7864; Y10T 70/8027; E05B 27/0017; E05B 27/0042; E05B 27/00; E05B 27/0053; E05B 27/08; E05B 75/00; E05B 19/043; E05B 19/04; E05B 19/00; E05B 19/0082; E05B 19/0058; E05B 19/0035; E05B 19/24; E05B 19/0017; E05B 19/0047; E05B 19/046; E05B 19/18; E05B 19/14

USPC ..... 70/16, 395–404

See application file for complete search history.

(56) References Cited

U.S. PATENT DOCUMENTS

| | | | | | |
|---|---|---|---|---|---|
| 384,592 | A * | 6/1888 | Ross | B25B 13/48 | 7/138 |
| 1,587,686 | A * | 6/1926 | Varnum | E05B 35/125 | 70/339 |
| 1,592,637 | A * | 7/1926 | Macri | E05B 35/004 | 235/144 M |
| 2,008,398 | A * | 7/1935 | Mangan | A45C 11/328 | 24/3.6 |

(Continued)

*Primary Examiner* — Suzanne Barrett
*Assistant Examiner* — Morgan McClure
(74) *Attorney, Agent, or Firm* — Bacon & Thomas, PLLC

(57) ABSTRACT

The present invention is to provide a structure of key part having hideable lock cylinder, which comprises a base unit having an end able to be fixed on an object body; a lock cylinder unit mounted at the other end of the base unit and provided with a cylinder column at an end thereof; and a key unit provided with a locking piece at a side edge of an end thereof, having the other end pivoted on the lock cylinder unit at a position near the cylinder column, and having a groove axially provided thereon for accommodating the cylinder column; whereby the cylinder column can be inserted into a lock adjusting slot of a handcuff, or can be hidden in the key unit while not in use. Thus, a user needs not to worry that pocket of his or her clothing will be hooked and damaged by the cylinder column.

13 Claims, 11 Drawing Sheets

(56) References Cited

U.S. PATENT DOCUMENTS 2,390,885 A * 12/1945 Kelley ..... E05B 75/00 70/16
2,662,390 A * 12/1953 Michnoff ..... E05B 17/16 70/395
2,681,492 A * 6/1954 Lackritz ..... A44B 19/28 24/416
3,526,112 A * 9/1970 Herrington ..... E05B 19/00 70/395
3,533,254 A * 10/1970 Albert ..... E05B 35/004 70/276
4,429,554 A * 2/1984 Litvin ..... E05B 19/00385 70/358
4,778,302 A * 10/1988 Martinez ..... B43K 29/00 401/110
5,046,343 A * 9/1991 Miwa ..... A45C 11/326 16/385
5,117,666 A * 6/1992 Keefer ..... A45C 11/321 70/456 R
5,460,022 A * 10/1995 Parsons ..... A45C 11/321 206/37.1
5,706,683 A * 1/1998 Napier ..... E05B 19/00 70/393
6,109,073 A * 8/2000 Parsons ..... E05B 19/00 70/16
6,280,046 B1 * 8/2001 Perez ..... F21V 33/0084 362/109
6,609,811 B1 * 8/2003 Sharrah ..... E05B 17/103 362/116
7,520,149 B1 * 4/2009 Roemmele ..... B43K 7/005 401/195
8,667,822 B1 * 3/2014 Jaffe ..... E05B 75/00 63/1.12
8,763,434 B2 * 7/2014 David ..... E05B 19/043 70/408
8,776,563 B1 * 7/2014 Jaffe ..... E05B 19/00 24/3.6
9,060,571 B2 * 6/2015 Hykamp ..... A44B 5/02
2005/0028570 A1 * 2/2005 Parsons ..... B43K 25/026 70/16
2006/0144106 A1 * 7/2006 Beresnitzky ..... A45C 11/328 70/456 R
2014/0007618 A1 * 1/2014 Brown, III ..... A44C 5/0038 63/1.18

* cited by examiner

STRUCTURE OF KEY PART HAVING HIDEABLE LOCK CYLINDER

FIELD OF THE INVENTION

The present disclosure is related to a lock device, more particularly to a structure of a key part having a hideable lock cylinder.

BACKGROUND OF THE INVENTION

The handcuffs can be used to bind a person's wrist and hands of the handcuffed person cannot act normal and large movement, so army and police personnel usually use handcuffs to restrict a suspect's action while seizing or detaining the suspect, in order to control the suspect's action efficiently. The person using the handcuffs and the condition of using the handcuffs are more special, so most of the manufacturers try to improve the design of the handcuffs and related products for enhancing convenience and security in use. An existing and common handcuffs having two-bolt lock is illustrated in the following paragraph.

Please refer to FIG. 1A and FIG. 1B. The handcuffs 1 includes two circular hooks 11 and a chain 13, the circular hook 11 is formed by assembling a cheek plate assembly 111 and a bow-type plate 113. an end of the bow-type plate 113 is pivotally linked with an end of the cheek plate assembly unit 111, and other end of the bow-type plate 113 can be inserted into an accommodating space 115 at other end of the cheek plate assembly unit 111 to fix with the other end of the cheek plate assembly 111; or, to cross other end of the cheek plate assembly 111 to the end of the cheek plate assembly 111. The cheek plate assembly 111 is provided with a keyhole 116, a lock adjusting slot 117, a clamping member 118 and a two-bolt lock plate 119 at the other end thereof. The keyhole 116 passes through a side surface of the cheek plate assembly 111. The lock adjusting slot 117, the clamping member 118 and the two-bolt lock plate 119 are located in the cheek plate assembly 111. An end of the clamping member 118 is pivoted on the cheek plate assembly 111. The two-bolt lock plate 119 can be moved horizontally, an end of the two-bolt lock plate 119 corresponds to the lock adjusting slot 117, and other end of the two-bolt lock plate 119 corresponds to the keyhole 116. The chain 13 is formed by at least one metal ring, and two ends of the chain 13 are connected to other ends of circular hooks 11 respectively. Therefore, the army and police personnel can lock the circular hooks 11 on the suspect's wrists, and efficiently restrict the suspect's hand movement within the length of the chain 13.

Please refer to FIG. 1A and FIG. 1B. When the army and police personnel lock the handcuffs on suspect's wrist, the other end of the bow-type plate 113 is inserted into the other end of the cheek plate assembly 111, and the other end of the clamping member 118 is engaged with the other end of the bow-type plate 113, whereby the handcuffs 1 is at a first locking status. Next, the army and police personnel can insert a rod 151 of an end of a key 15 into the lock adjusting slot 117 to push the two-bolt lock plate 119, to enable the two-bolt lock plate 119 to constrain the clamping member 118, so that the other end of the clamping member 118 is hard to depart from the status of engaging with the other end of the bow-type plate 113, and the handcuffs 1 is entered a second locking status. Therefore, when the suspect inserts other object into the keyhole 116 and intends to move the clamping member 118, the two-bolt lock plate 119 can stop the suspect from opening the handcuffs 1 well. When wanting to loosen up the handcuffs 1, the army and police personnel can insert a locking piece 153 of other end of the key 15 into the keyhole 116 in advance, to push the two-bolt lock plate 119 to move reversely for lifting the restriction applied on the clamping member 118. The army and police can then rotate the key 15 again to open the handcuffs 1.

According to the above-mentioned illustration, the handcuffs having two-bolt lock is adopted by most army and police personnel due to its higher security. The army and police personnel usually have to carry the key 15 for correctly locking or unlocking the handcuffs 1 by the rod 151 and the locking piece 153 of the key 15. However, the key 15 is usually designed in small size and easily intermingled with litter in the pocket, so the army and police personnel must rummage the litter in the pocket repeatedly to find the key. In this situation, it not only causes the inconvenience in use for the army and police personnel, but also increases the anxiety of the army and police personnel during the process of rummaging the key 15. In addition, the rod 151 of the key 15 is very thin, so the rod 151 is easy to hook the line of the clothes while the key 15 is placed in a pocket of a knitted shirt, clothes or pants made of similar material. Therefore, the army and police personnel cannot easily take out the key 15, the line of the clothes or pants may further be broken while the key 15 is dragged forcibly, and it may cause that the army and police personnel must pay extra expense for buying clothes. Moreover, some manufacturers design the key as a ball-point pen shape to solve the problem of rummaging or lost due to the small size of the key, but the rod and the locking piece of the key having ball-point pen shape are still separately disposed at two ends, the problem of hooking the line still happen while the army and police personnel carry the key having ball-point pen shape, and the exterior appearance of such key is grotesque and not easy to be accepted widely.

Therefore, what is need is to design a key having more appropriate structure to solve the above-mentioned problem in use, so that the army and police personnel can carry the key conveniently and lock or unlock the handcuffs quickly.

SUMMARY OF THE INVENTION

The key of existing handcuffs has above-mentioned defects and cannot meet the user's demand, so the inventor develops a structure of a key part having hideable lock cylinder based on long-term research and experiment, whereby the above-mentioned problems can be solved, the manufacturer can provide more convenient product to user, and the market competitiveness of the manufacturer can be enhanced.

An objective of the present disclosure is to provide a structure of a key part having a hideable lock cylinder, and the key part includes a base unit, a hollow pipe, a lock cylinder unit and a key unit. The base unit can be fixed on an object body (such as a pen cap, a pen shaft or a nightstick), or be a portion of the object body. The base unit is provided with at least one positioning piece at an end thereof. An end of the hollow pipe is connected with an end of the base unit and the hollow pipe has a first accommodating space and a second accommodating space inside. A diameter width of the first accommodating space is larger than a diameter width of the second accommodating space, and a shoulder portion is formed at a linking portion between the first accommodating space and the second accommodating space. In addition, the positioning piece is inserted into the first accommodating space and an end of the positioning piece is spaced apart from the shoulder portion by an interval. Moreover, the lock cylinder unit is disposed inside the hollow pipe and axially movable in the hollow pipe, the lock cylinder unit is provided with a cylinder column at an end thereof and a clamping block at other end thereof. The clamping block can be selectively abutted against an end of the base unit, or moved to the interval and then rotated to abut against an end of the positioning piece to enable the core column being exposed out of the hollow pipe. Moreover, the key unit is provided with a locking piece disposed at a side edge of an end thereof, other end of the key unit is pivoted on the lock cylinder unit and near the cylinder column. The key unit is provided with a groove disposed axially to accommodate the cylinder column, so that the locking piece can be inserted into a keyhole of a handcuffs, or the key unit can be rotated on the lock cylinder unit while the cylinder column is exposed out of the hollow pipe, to enable the cylinder column being departed from the groove and exposed out of the key unit, whereby the cylinder column can be inserted into a lock adjusting slot of the handcuffs. Therefore, the cylinder column can be hidden in the key unit while not in use, and the user need not worry that the clothing will be hooked and damaged by the cylinder column.

A second objective of the present disclosure is that the base unit is provided with a magnetic component and the clamping block of the lock cylinder unit is also magnetic material, so that the lock cylinder unit can be fixed on the base unit. Therefore, while the user carry the key part, the lock cylinder unit can be prevented from sliding out of the hollow pipe, so the key unit can be prevented from being rotated to expose the cylinder column which may hook the clothing.

A third objective of the present disclosure is that the lock cylinder unit is sleeved with an elastic element near the other portion thereof, an end of the elastic element is abutted against the shoulder portion, and other end of the elastic element is abutted against the clamping block. The clamping block is applied a force toward the base unit by the elastic element. Therefore, after the user finishes using the cylinder column, the user can just rotate the key unit to hide the cylinder column in the groove, and then rotate the lock cylinder unit to make the clamping block leave the position where the clamping block is abutted against the positioning piece, so that the lock cylinder unit will be automatically received into the hollow pipe, and the convenience in use can be improved efficiently.

A fourth objective of the present disclosure is that the hollow pipe is provided with a plurality of inner screw threads inside and the lock cylinder unit is provided with a plurality of outer screw threads thereon. Therefore, the lock cylinder unit can be axially moved by the outer screw threads and the inner screw threads, to prevent the lock cylinder unit from sliding out the hollow pipe arbitrarily, whereby the cylinder column can be exposed out of the key unit entirety.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1A:
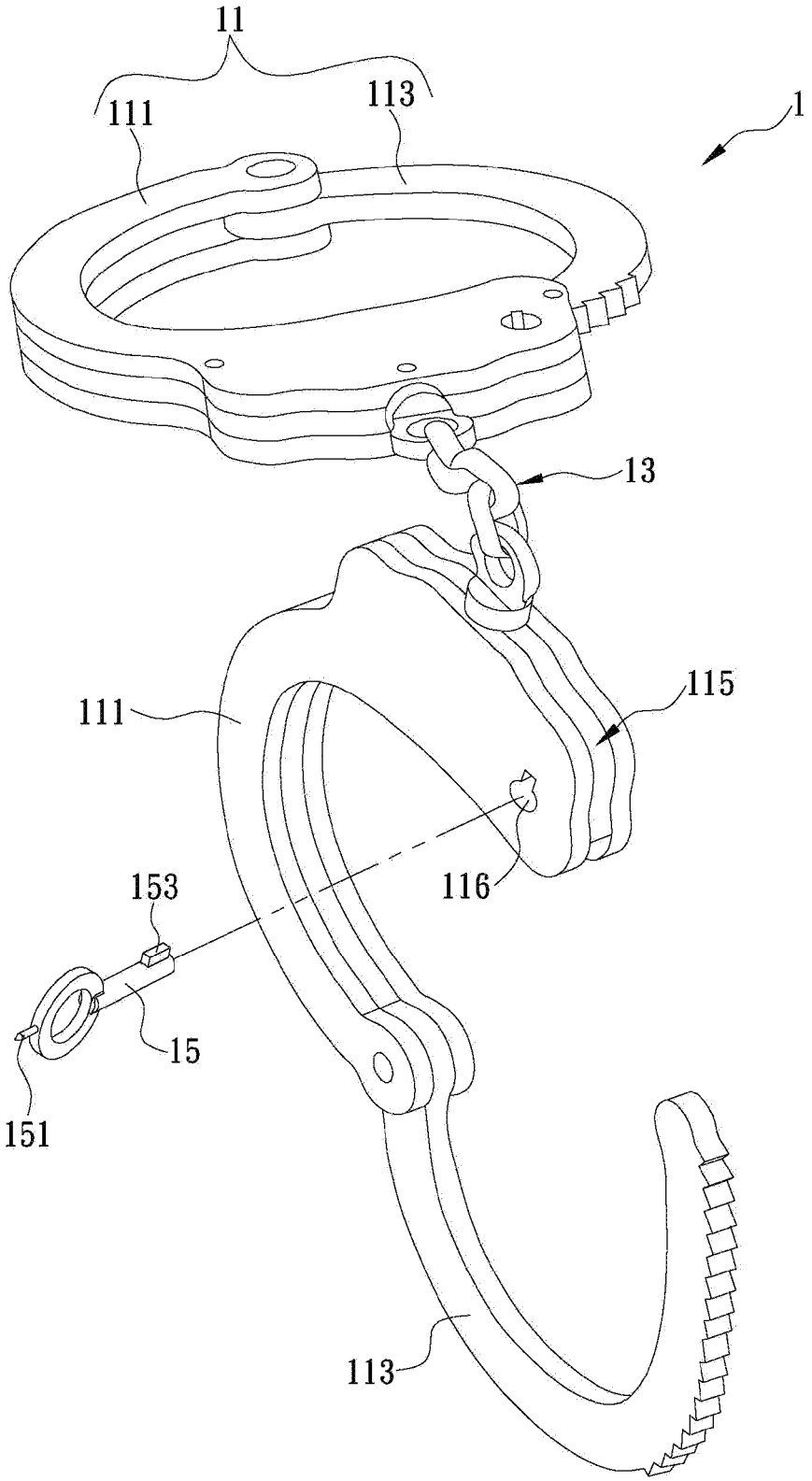
FIG. 1A(Prior Art)
FIG. 1A is a schematic view of key and handcuffs in prior art.
Figure 1B:
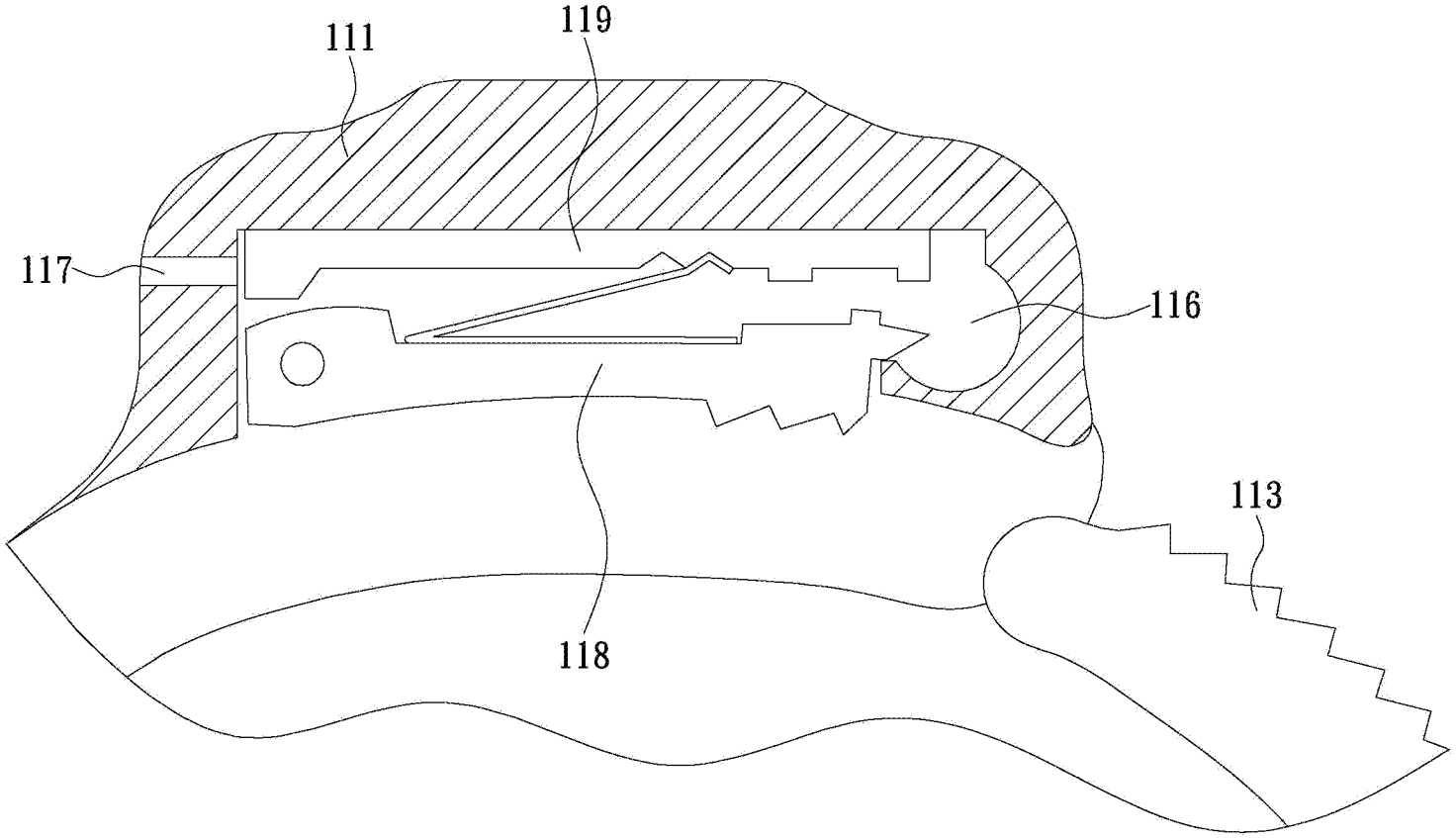
FIG. 1B(Prior Art)
FIG. 1B is a partial section view of the handcuffs in prior art.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure illustrates a structure of a key part having a hideable lock cylinder, in a first embodiment of the present disclosure the key part being a portion of a tactical pen is taken as example for illustration. Please refer to FIG. 2 and FIG. 3. The tactical pen is formed by a key part 2, a center part 2A and a pen cap part 2B. The key part 2 includes a base unit 21, a hollow pipe 23, a lock cylinder unit 25 and a key unit 27. The base unit 21 can be assembled on the center part 2A, and a pen shaft of the tactical pen is formed by the base unit 21 and the center part 2A. However, it should be noted that in other embodiment of the present disclosure the base unit 21 can be designed in different shape and assembled on various object body (such as nightstick, jackknife, electric torch, etc.) by a fastening manner or other fixing manner, or be a portion of the object body, or be an individual having independent formation.

Figure 2:
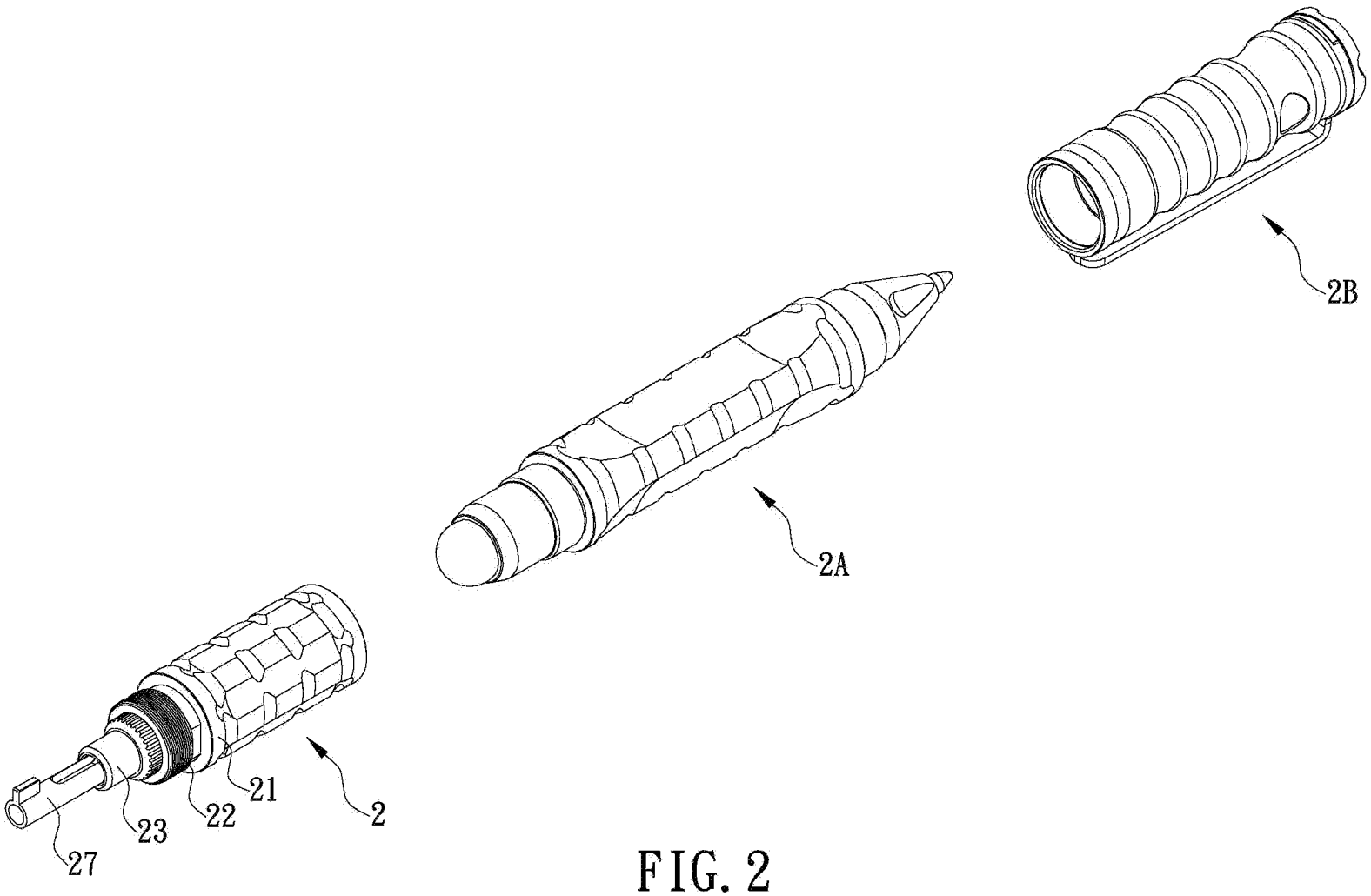
FIG. 2 is a schematic view of a tactical pen of a first embodiment of the present disclosure.
Figure 3:
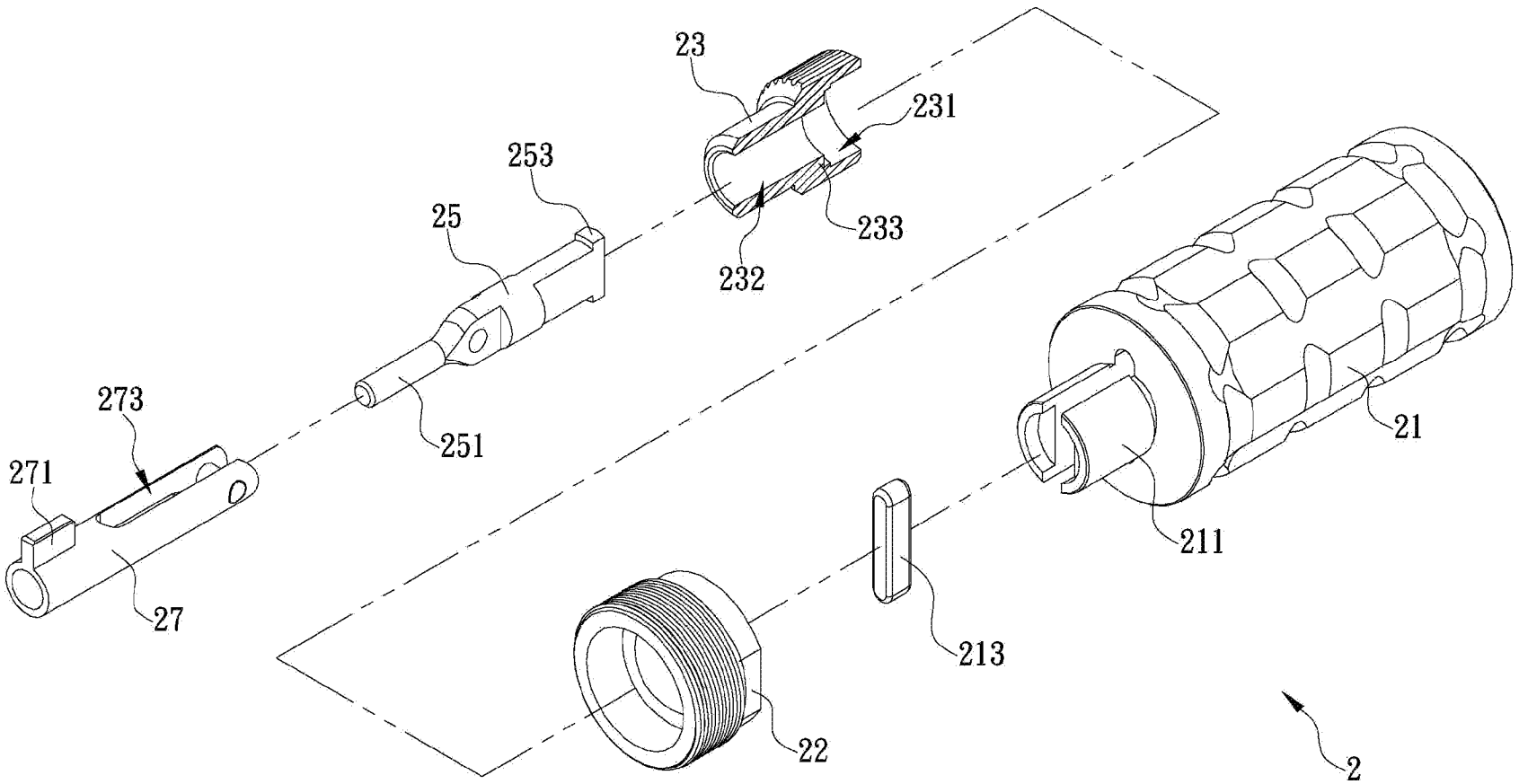
FIG. 3 is a exploded view of a key part of the first embodiment of the present disclosure.

As shown in FIG. 2 and FIG. 3, the base unit 21 has at least one positioning piece 211 protrudingly disposed at an end thereof. In the first embodiment, two positioning pieces 211 are provided and spaced apart by a distance. An end of the hollow pipe 23 is connected to an end of the base unit 21, in the first embodiment a connection portion 22 is assembled at other end of the base unit 21. The connection portion 22 has a screw thread disposed thereon for being screwed with the pen cap part 2B. However, it should be noted that in other embodiment of the present disclosure the base unit 21 can be designed without the connection portion 22 or with other combination structure on the connection portion 22, according to design demands of different products. For example, the other combination structure can be a protrudent block, a groove portion, etc. Moreover, in order to show the whole structural features of the hollow pipe 23 clearly, a section view of a part of the hollow pipe 23 is shown in FIG. 3. A portion of the hollow pipe 23 is inserted into the connection portion 22, and a first accommodating space 231 and a second accommodating space 232 are formed inside the hollow pipe 23. A diameter width of the first accommodating space 231 is larger than a diameter width of the second accommodating space 232, and a shoulder portion 233 is formed at a linking portion between the first accommodating space 231 and the second accommodating space 232. Please refer to FIG. 4A. The positioning piece 211 is inserted into the first accommodating space 231, and an end of the positioning piece 211 is spaced apart from the shoulder portion 233 by an interval L1. In the embodiment, an end of the positioning piece 211 is a recessed shape to form the interval L1; however, it should be noted that in other embodiment of the present disclosure, an end of the positioning piece 211 can be not abutted against the shoulder portion 233 in order to form the interval L1.

Please refer to FIG. 2 through FIG. 4A, the lock cylinder unit 25 is disposed inside the hollow pipe 23 and axially movable within the hollow pipe 23. The lock cylinder unit 25 is provided with a cylinder column 251 disposed at an end thereof and a clamping block 253 disposed at other end thereof, and the clamping block 253 can be abutted against an end of the base unit 21. In the embodiment, the clamping block 253 can be made of magnetic material, and the base unit 21 is provided with a magnetic unit 213 at an end thereof corresponding to the clamping block 253, whereby the clamping block 253 can be connected with the base unit 21 and not easily separated from the base unit 21. Please refer to FIG. 4B. After the lock cylinder unit 25 is applied a force larger than a force of the magnetic unit 213, the clamping block 253 is moved to the position of the interval L1, and the cylinder column 251 can be entirety exposed out of the hollow pipe 23. Please refer to FIG. 4C. The lock cylinder unit 25 can still be rotated to abut against an end of the positioning piece 211. Therefore, after the cylinder column 251 is stressed, the lock cylinder unit 25 will not be moved back to a position of an end of the base unit 21.

Figure 4A:
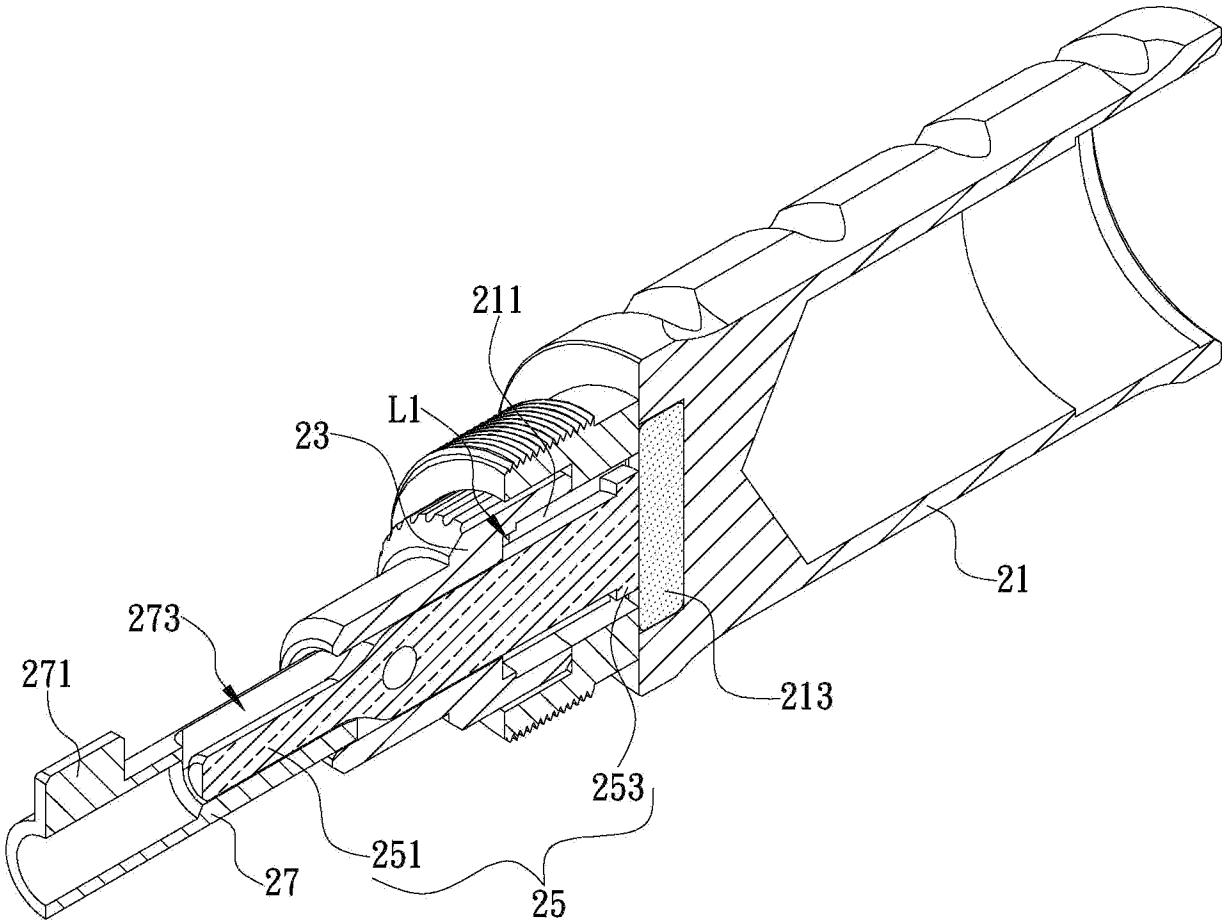
FIG. 4A is a first status view of the key part of the first embodiment of the present disclosure.
Figure 4B:
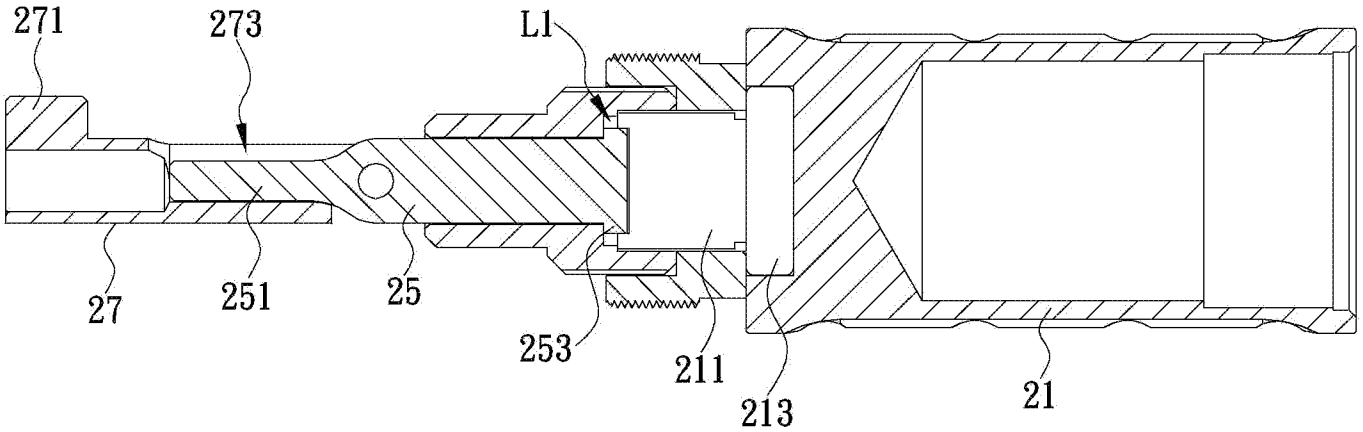
FIG. 4B is a second status view of the key part of the first embodiment of the present disclosure.
Figure 4C:
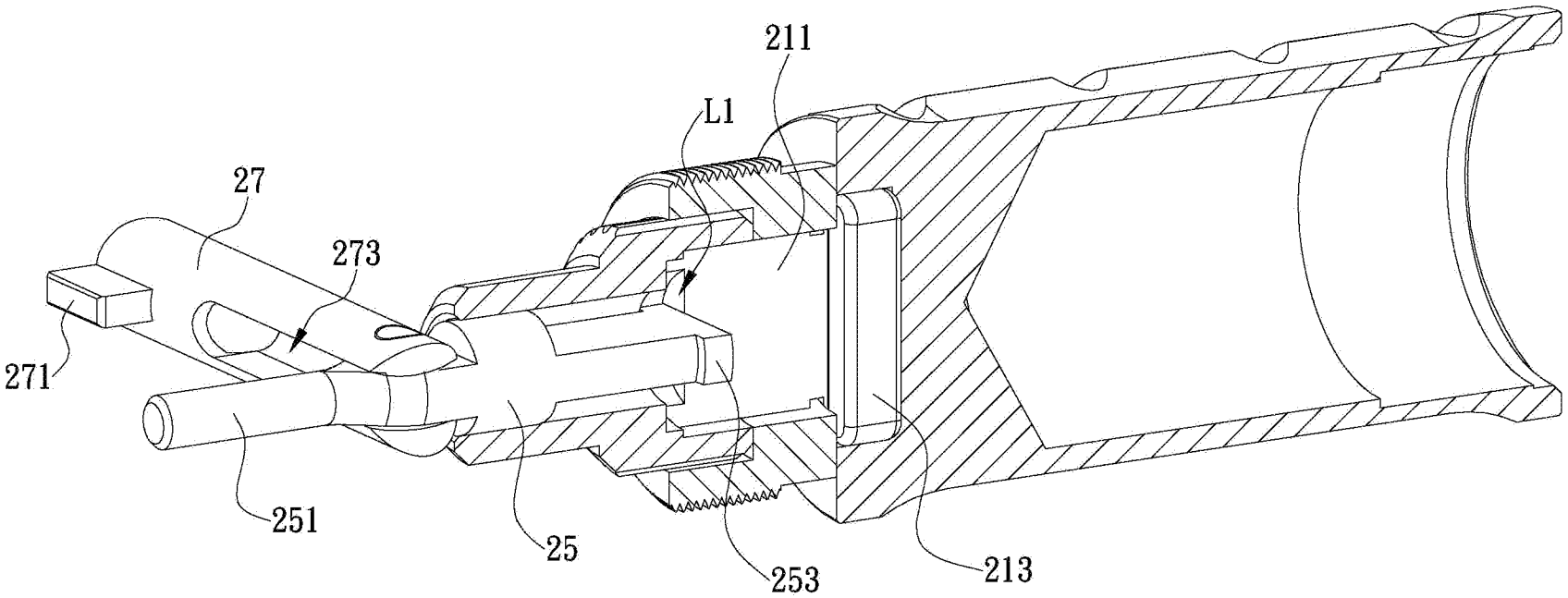
FIG. 4C is a third status view of the key part of the first embodiment of the present disclosure.
Figure 5:
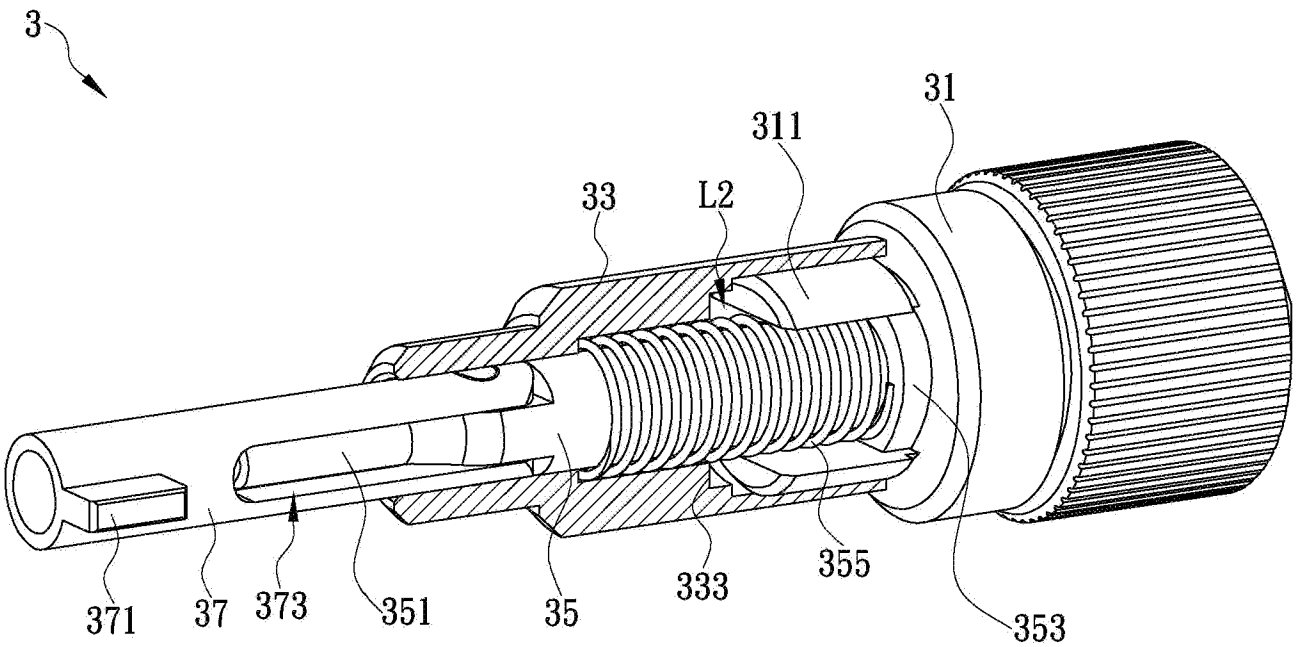
FIG. 5 is a first status view of the key part of a second embodiment of the present disclosure.

Please refer to FIG. 2 through FIG. 4A. The key unit 27 is provided with a locking piece 271 disposed at a side edge of an end thereof, and other end of the key unit 27 is pivoted on the lock cylinder unit 25 at a position near the cylinder column 251, and the key unit 27 is provided with a groove 273 axially disposed thereon, so that the cylinder column 251 can be accommodated within the groove 273 (as shown in FIG. 4A), and the locking piece 271 can be inserted into a keyhole of a handcuffs. Moreover, after the user holds the key unit 27 to pull the key unit 27, the key unit 27 and the lock cylinder unit 25 are moved together (as shown in FIG. 4B). After the clamping block 253 is moved to the position of the interval L1 and rotated to abut against an end of the positioning piece 211, the portion where the key unit 27 and the lock cylinder unit 25 are pivotally linked is exposed out of the hollow pipe 23, whereby the key unit 27 can be rotated on the lock cylinder unit 25 to enable the cylinder column 251 to be departed from the groove 273 and exposed out of the key unit 27 (as shown in FIG. 4C), and the cylinder column 251 can be inserted into a lock adjusting slot of the handcuffs. Therefore, the cylinder column 251 can be hidden in the key unit 27 while not in use, and the user need not worry that clothing are hooked and damaged by the cylinder column 251 during carrying. When the user wants to use the cylinder column 251, the user just pulls and then rotates the key unit 27 to enable the cylinder column 251 being exposed out. After use, the user can rotate and then push the key unit 27 again to hide the cylinder column 251 and use the locking piece 271.

Figure 6:
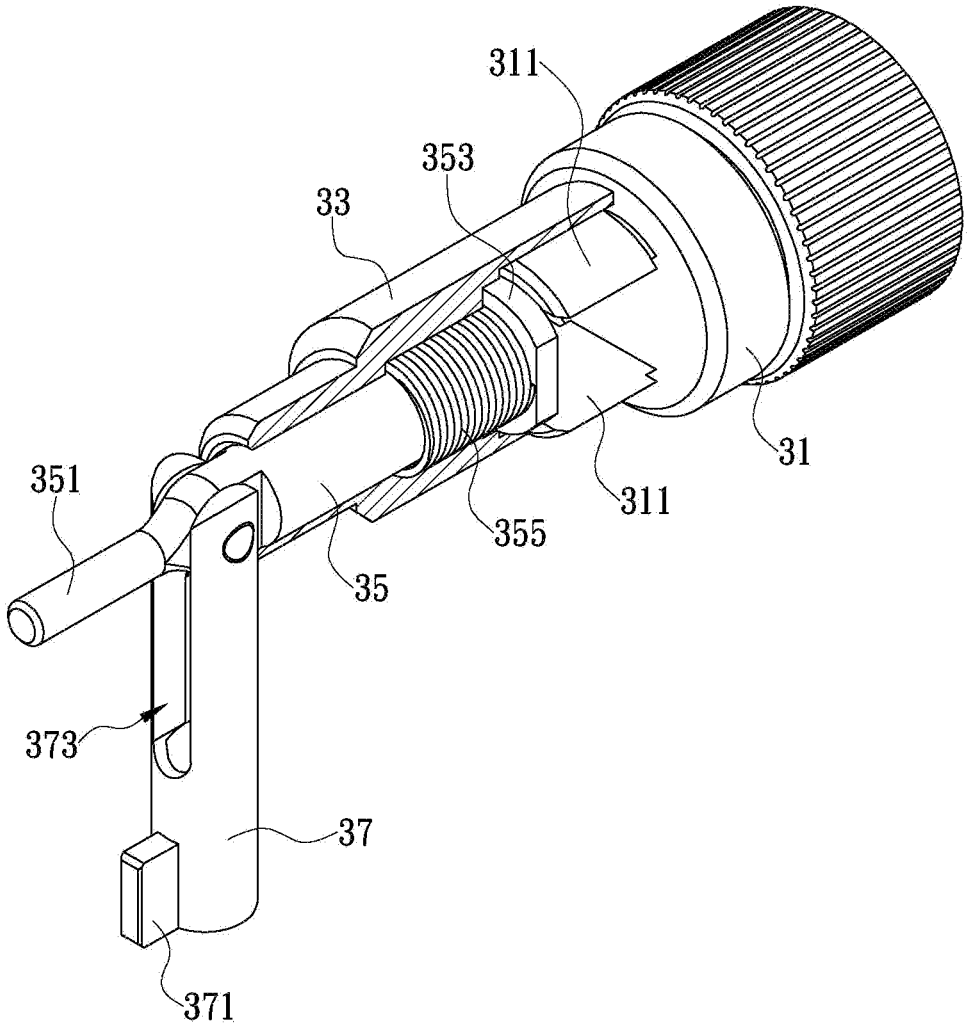
FIG. 6 is a second status view of the key part of the second embodiment of the present disclosure.
Figure 7A:
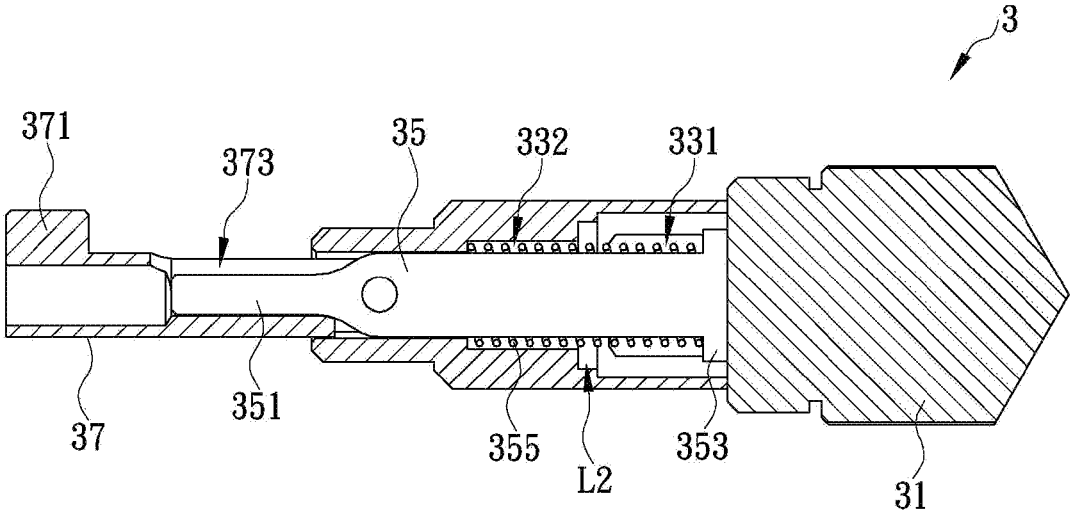
FIG. 7A is a section view of FIG. 5.
Figure 7B:
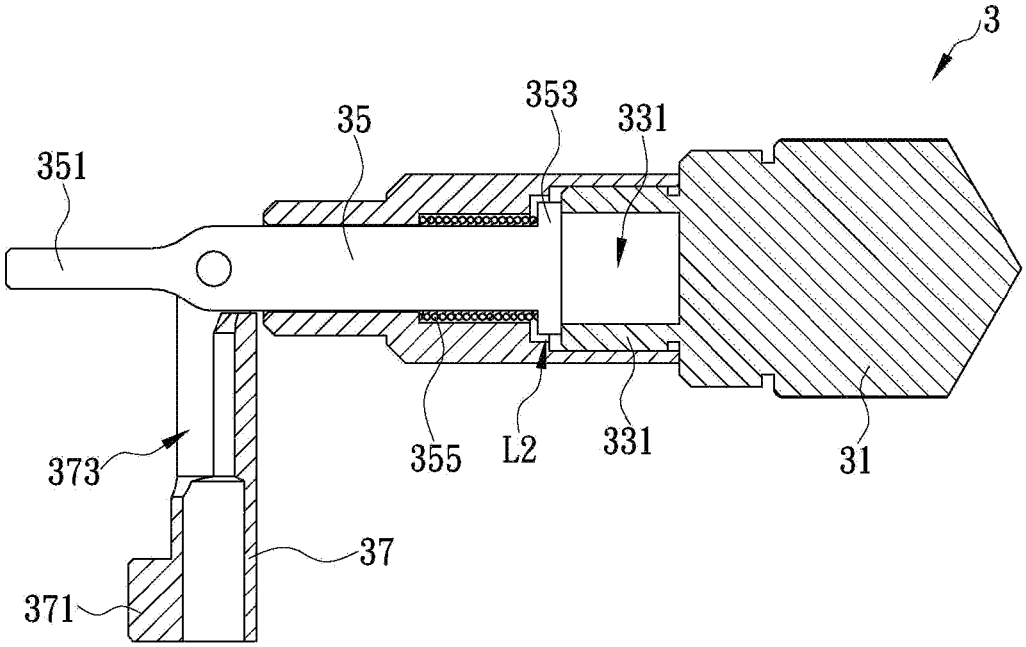
FIG. 7B is a section view of FIG. 6.

In other embodiment of the present disclosure, the manufacturer can design the base unit without the magnetic unit, or adopt other manner to position the lock cylinder unit. Please refer to FIG. 5 through FIG. 7B. The key part 3 is a tactical pen or a cover of a nightstick, and the key part 3 includes a base unit 31, a hollow pipe 33, a lock cylinder unit 35 and a key unit 37. The base unit 31 is a portion of the cover and provided with two positioning pieces 311 at an end thereof. The end of the hollow pipe 33 is connected with an end of the base unit 31, and the hollow pipe has a first accommodating space 331 and a second accommodating space 332 (as shown in FIG. 7A) formed inside. A diameter width of the first accommodating space 331 is larger than a diameter width of the second accommodating space 332, and a shoulder portion 333 is formed at a linking portion between the first accommodating space 331 and the second accommodating space 332. After the positioning piece 311 is inserted into the first accommodating space 331, an end of the positioning piece 311 is spaced apart from the shoulder portion 333 by an interval L2. Moreover, the lock cylinder unit 35 is disposed inside the hollow pipe 33, and axially movable within the hollow pipe 33. The lock cylinder unit 35 is provided with a cylinder column 351 at an end thereof and a clamping block 353 at other end thereof. The lock cylinder unit 35 is provided with an elastic element 355 sleeved near other end thereof, an end of the elastic element 355 is abutted against the shoulder portion 333, and other end of the elastic element 355 is abutted against the clamping block 353. The clamping block 353 is abutted against an end of the base unit 31 by the force of the elastic element 355. The key unit 37 is provided with a locking piece 371 at a side edge of an end thereof, other end of the key unit is pivoted on the lock cylinder unit 35 at a position near the core column 351, and the key unit is axially provided with a groove 373 to accommodate the core column 351. After the user pulls the key unit 37, the lock cylinder unit 35 is moved simultaneously, and the clamping block 353 of the lock cylinder unit 35 will pressure the elastic element 355, so the elastic element 355 is retracted and the force which makes the clamping block 353 move toward the base unit 31 is accumulated. After the user moves the clamping block 353 to the position of the interval L2, the lock cylinder unit 35 can be rotated to enable the clamping block 353 to abut against an end of the positioning piece 311 (as shown in FIG. 6 and FIG. 7). Therefore, the user can rotate the key unit 37 to enable the cylinder column 351 to be departed from the groove 373 and exposed out of the key unit 37; after use, the user can rotate the key unit 37 again to make the cylinder column 351 be accommodated within the groove 373. Next, the user can rotate the key unit 37 to enable the clamping block 353 to be departed from the position where the clamping block 353 is abutted against the positioning piece 311, and the elastic element 355 automatically pushes the clamping block 353 to enable the clamping block 353 to abut against the end of the base unit 31.

Figure 8A:
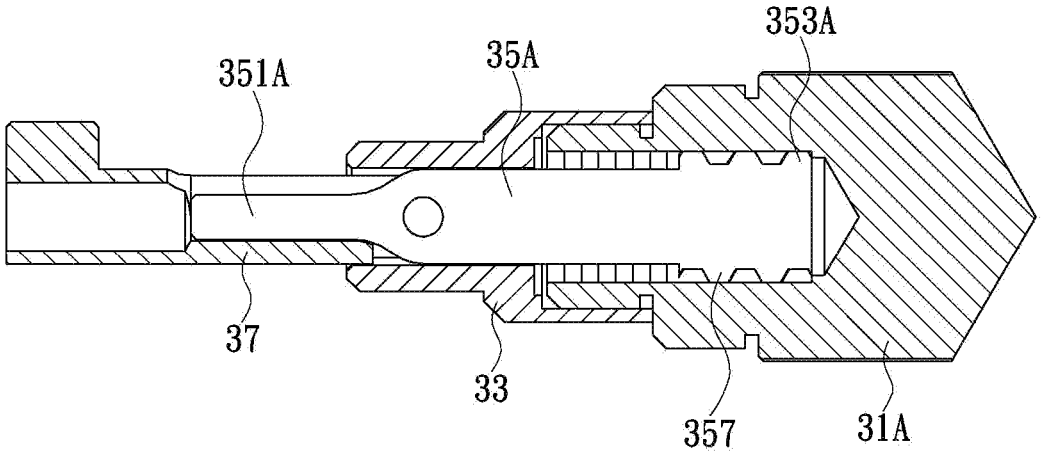
FIG. 8A is a first status view of a key part of a third embodiment of the present disclosure.
Figure 8B:
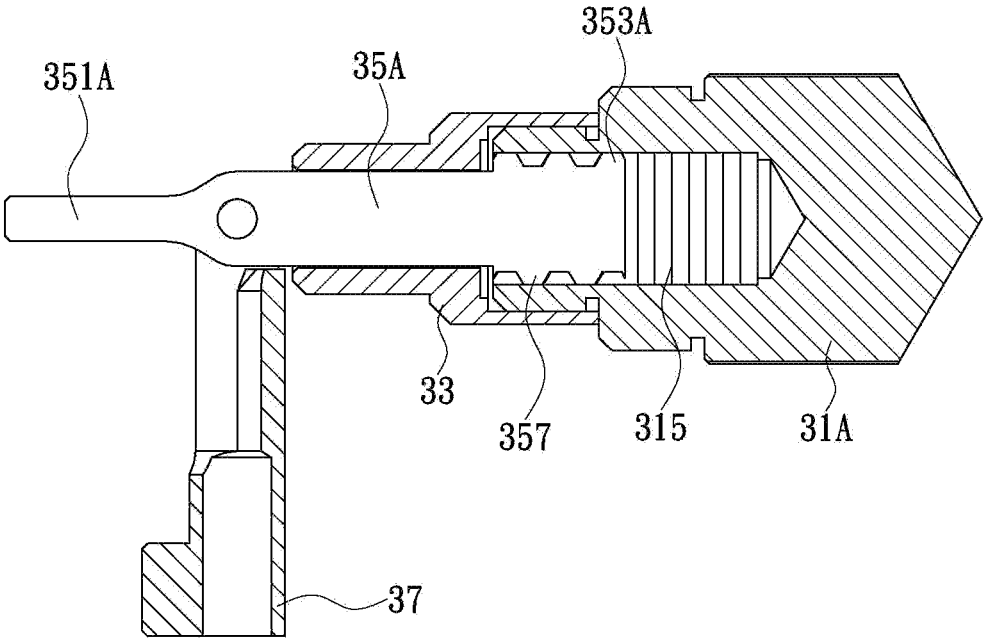
FIG. 8B is a second status view of the key part of the third embodiment of the present disclosure.

In a third embodiment of the present disclosure, the manufacturer can design the lock cylinder unit 35 without the elastic element, but adopting the screwing manner. In the FIG. 8A and FIG. 8B, the components which have the connection relationships equal to the second embodiment are designated the previous reference numerals, and their detailed descriptions are omitted. The components different from the second embodiment are designated new reference numerals and described in following paragraph. Moreover, the lock cylinder unit 35A is provided with a cylinder column 351A at an end thereof, a clamping block 353A at other end thereof, and a plurality of outer screw threads 357 disposed near the other end. Moreover, the base unit 31A is provided with a plurality of inner screw threads 315 inside, so the lock cylinder unit 35A can be axially movable via the outer screw threads 357 and the inner screw threads 315, and the portion where the lock cylinder unit 35A and the key unit 37 are pivotally linked can be located inside the hollow pipe 33 or be moved out of the hollow pipe 33.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A structure of a key part having a hideable lock cylinder, comprising:

a base unit having an end able to be fixed on an object body or to be a portion of the object body;

a lock cylinder unit mounted at an other end of the base unit and provided with a cylinder column at an end thereof; and a key unit provided with a locking piece at a side edge of an end thereof, an other end of the key unit pivoted on the lock cylinder unit at a position near the cylinder column, and the key unit axially provided with a groove to accommodate the cylinder column;

whereby, the cylinder column can be departed from the groove and exposed out of the key unit for being inserted into a lock adjusting slot of a handcuffs and enabling the handcuffs to be in an unopenable status, or the cylinder column can be accommodated within the groove for enabling the key unit along with the locking piece to be inserted into a keyhole of the handcuffs and to open the handcuffs.

2. The structure of the key part as defined in claim 1, further comprising:

at least one positioning piece protrudingly disposed at an end of the base unit; and a hollow pipe having an end connected with an end of the base unit and having a first accommodating space and a second accommodating space formed inside, wherein a diameter width of the first accommodating space is larger than a diameter width of the second accommodating space, a shoulder portion is formed at a linking portion between the first accommodating space and the second accommodating space, the positioning piece is inserted into the first accommodating space, and an end of the positioning piece is apart from the shoulder portion by an interval;

wherein the lock cylinder unit is disposed inside the hollow pipe and axially movable within the hollow pipe, the lock cylinder unit is provided with a clamping block at an other end thereof, the clamping block is selectively abutted against the end of the base unit, or moved to the interval and rotated to abut against the end of the positioning piece to make the cylinder column be exposed out of the hollow pipe;

wherein, when the cylinder column is exposed out of the hollow pipe, the key unit is rotatable in the lock cylinder unit to enable the cylinder column to depart from the groove and be exposed out of the key unit.

3. The structure of the key part as defined in claim 2, wherein the clamping block is made of magnetic material, and the base unit is provided with a magnetic unit at a position corresponding to the clamping block, whereby the clamping block can be connected on the base unit by the magnetic unit.

4. The structure of the key part as defined in claim 3, wherein the lock cylinder unit is sleeved with an elastic element near the other end thereof, an end of the elastic element is abutted the shoulder portion, an other end of the elastic element is abutted the clamping block, and the clamping block is applied a force toward the base unit by the elastic element.

5. The structure of the key part as defined in claim 2, wherein the hollow pipe has a plurality of inner screw threads inside, the lock cylinder unit has a plurality of outer screw threads near the other end thereof, and the lock cylinder unit is axially movable within the hollow pipe through the plurality of outer screw threads and the plurality of inner screw threads.

6. The structure of the key part as defined in claim 2, further comprising a connection portion disposed at the end of the base unit, and the hollow pipe partially inserted into the connection portion.

7. The structure of the key part as defined in claim 3, further comprising a connection portion disposed at the end of the base unit, and the hollow pipe partially inserted into the connection portion.

8. The structure of the key part as defined in claim 4, further comprising a connection portion disposed at the end of the base unit, and the hollow pipe partially inserted into the connection portion.

9. The structure of the key part as defined in claim 5, further comprising a connection portion disposed at the end of the base unit, and the hollow pipe partially inserted into the connection portion.

10. The structure of the key part as defined in claim 6, wherein the end of the positioning piece is a recessed shape to form the interval.

11. The structure of the key part as defined in claim 7, wherein the end of the positioning piece is a recessed shape to form the interval.

12. The structure of the key part as defined in claim 8, wherein the end of the positioning piece is a recessed shape to form the interval.

13. The structure of the key part as defined in claim 9, wherein the end of the positioning piece is a recessed shape to form the interval.

* * * * *